US009103079B2

(12) United States Patent
Schlenker et al.

(10) Patent No.: US 9,103,079 B2
(45) Date of Patent: Aug. 11, 2015

(54) GROUND CHARACTERISTIC MILLING MACHINE CONTROL

(71) Applicant: Caterpillar Paving Products Inc., Brooklyn Park, MN (US)

(72) Inventors: Brian J. Schlenker, Plymouth, MN (US); Jason W. Muir, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 75 days.

(21) Appl. No.: 14/062,981

(22) Filed: Oct. 25, 2013

(65) Prior Publication Data

US 2015/0117951 A1 Apr. 30, 2015

(51) Int. Cl.
*E01C 23/088* (2006.01)
*E01C 23/06* (2006.01)

(52) U.S. Cl.
CPC ..... *E01C 23/065* (2013.01); *E01C 2301/00* (2013.01)

(58) Field of Classification Search
USPC ..... 404/84.05, 84.1, 94; 299/1.5, 39.7
IPC ..... E10C 23/088,23/127
See application file for complete search history.

(56) References Cited

U.S. PATENT DOCUMENTS 5,031,705 A 7/1991 Clemens
5,607,205 A 3/1997 Burdick et al.
6,064,926 A 5/2000 Sarangapani et al.
6,082,466 A 7/2000 Gudat
6,152,648 A 11/2000 Gfroerer et al.
6,371,566 B1 * 4/2002 Haehn ..... 299/1.5
6,437,726 B1 8/2002 Price
7,434,889 B2 * 10/2008 Moller et al. ..... 299/1.5
7,717,521 B2 5/2010 Hall et al.
7,828,392 B2 * 11/2010 Hall et al. ..... 299/1.5
7,865,285 B2 1/2011 Price et al.
8,292,371 B2 * 10/2012 Menzenbach et al. ..... 299/1.5
8,424,972 B2 * 4/2013 Berning et al. ..... 299/1.5
8,485,755 B2 * 7/2013 Menzenbach et al. ..... 404/84.05
8,511,932 B2 * 8/2013 Jurasz et al. ..... 404/75
8,632,132 B2 * 1/2014 Menzenbach et al. ..... 299/1.5
8,764,341 B2 * 7/2014 Menzenbach et al. ..... 404/75
8,899,689 B2 * 12/2014 Killion ..... 299/1.5
2008/0153402 A1 * 6/2008 Arcona et al. ..... 451/352

* cited by examiner

*Primary Examiner* — Gary Hartmann
(74) *Attorney, Agent, or Firm* — Andrew A. Phillips

(57) ABSTRACT

A milling machine includes a frame, a rotor coupled to the frame and vertically adjustable, a chamber coupled to the frame and at least partially surrounding the rotor, a speed sensor configured to measure a speed of the machine, a height sensor configured to measure a height of the rotor, a ground characteristic sensor configured to measure a ground characteristic, and a controller. The controller is configured to receive the speed of the machine from the speed sensor, receive the height of the rotor from the height sensor, receive the ground characteristic from the ground characteristic sensor, determine a target speed for the machine, determine a target height for the rotor, adjust the speed of the machine to the target speed, and adjust the height of the rotor to the target height.

10 Claims, 5 Drawing Sheets

GROUND CHARACTERISTIC MILLING MACHINE CONTROL

TECHNICAL FIELD

Embodiments of the present disclosure pertain to a milling machine and, more particularly, to a milling machine capable of control based on a sensed ground characteristic.

BACKGROUND

A milling machine may be used as a soil stabilizer to cut, mix, and pulverize native in-place soils with additives or aggregates to modify and stabilize the soil for a strong base. A milling machine may also be used as a road reclaimer to pulverize a surface layer, such as asphalt, and can mix it with an underlying base to create a new road surface and stabilize deteriorated roadways. Optionally, a milling machine can add asphalt emulsions or other binding agents to create a new road surface during pulverization or during a separate mix pass. A milling machine may also be used to remove a layer from the ground.

Milling machines generally use a rotor equipped with cutting tools to cut into the ground. The rotor may be damaged if it comes into contact with an underground object. An operator of a milling machine may be unaware of the presence of the underground object and may not have any knowledge a U.S. Pat. No. 5,607,205 to Burdick discloses an automatic object responsive control system for controlling a work implement of a work machine. The control system includes a work implement, ground penetrating means, object detecting means, and implement control means. The object detection means determine the presence of an undesirable object and sends a signal to the implement control means to raise the work implement. The present application provides additional benefits to those presented in the Burdick patent.

SUMMARY

One aspect of the present disclosure is directed to a milling machine that includes a frame, a rotor coupled to the frame and vertically adjustable, a chamber coupled to the frame and at least partially surrounding the rotor, a speed sensor configured to measure a speed of the machine, a height sensor configured to measure a height of the rotor, a ground characteristic sensor configured to measure a ground characteristic, and a controller. The controller is configured to receive the speed of the machine from the speed sensor, receive the height of the rotor from the height sensor, receive the ground characteristic from the ground characteristic sensor, determine a target speed for the machine, determine a target height for the rotor, adjust the speed of the machine to the target speed, and adjust the height of the rotor to the target height.

Another aspect of the present disclosure is directed to a milling machine that includes a frame, a rotor coupled to the frame, a chamber coupled to the frame and at least partially surrounding the rotor, means for measuring a speed of the machine, means for measuring a height of the rotor, means for measuring a ground characteristic, means for adjusting the height of the rotor in response to the ground characteristic, and means for adjusting the speed of the machine in response to the ground characteristic.

Another aspect of the present disclosure is directed to a milling machine that includes a frame, a rotor coupled to the frame and vertically adjustable, a chamber coupled to the frame and at least partially surrounding the rotor, a speed sensor configured to measure a speed of the machine, a height sensor configured to measure a height of the rotor, a ground characteristic sensor configured to measure a ground characteristic, and a controller. The controller is configured to receive the speed of the machine from the speed sensor, receive the height of the rotor from the height sensor, receive the ground characteristic from the ground characteristic sensor, determine a target speed for the machine based on the ground characteristic, determine a target height for the rotor based on the ground characteristic, adjust the speed of the machine to the target speed, and adjust the height of the rotor to the target height.

Other features and aspects of this disclosure will be apparent from the following description and the accompanying drawings.

DETAILED DESCRIPTION

Exemplary embodiments of the present disclosure are presented herein with reference to the accompanying drawings. Herein, like numerals designate like parts throughout.

Figure 1:
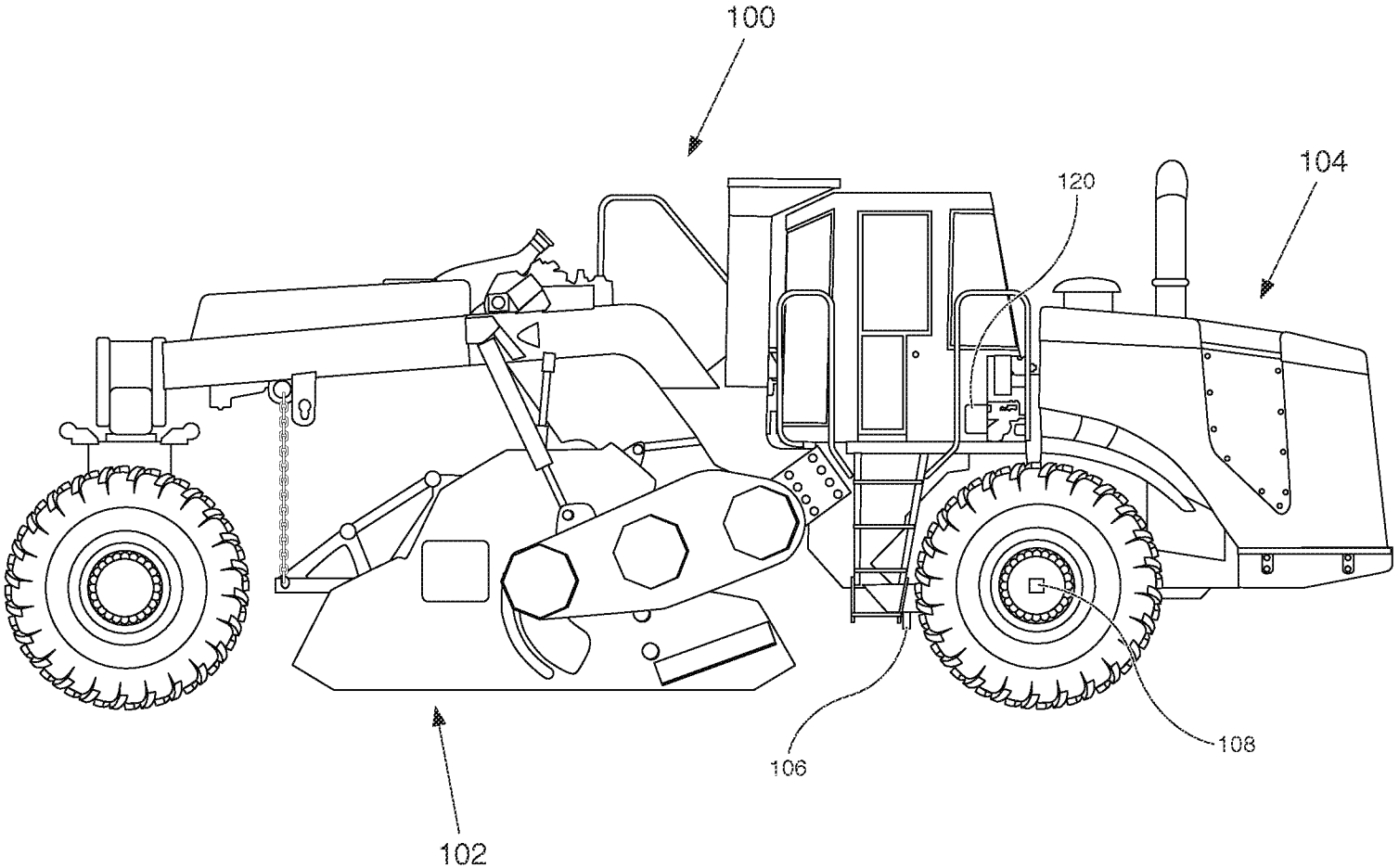
FIG. 1 is a diagrammatic view of an exemplary machine having a chamber.

FIG. 1 illustrates an exemplary machine 100, in this case, a rotary mixer. Although FIG. 1 shows a rotary mixer, any other machine used in milling, road reclamation, soil stabilization, surface pulverization, or other applications is contemplated by the present disclosure, such as a cold planer. According to FIG. 1, machine 100 includes a chamber 102 and a frame 104. Machine 100 also includes a sensor 106 for measuring a ground characteristic, a sensor 108 for measuring the speed of machine 100, and a controller 120. One of skill in the art will appreciate that sensor 106 and sensor 108 may be located at other locations on machine 100 and still be capable of measuring a ground characteristic, in the case of sensor 106, and the speed of machine 100, in the case of sensor 108. Sensor 106 should be positioned in front of chamber 102 as will be described in further detail.

Sensor 106 measures a ground characteristic. This ground characteristic may be the density of the ground, the material thickness of the ground, or detection of whether an object is present under the ground that would cause damage to rotor 202 (illustrated in FIG. 2). Sensor 106 may be a ground penetrating radar, or any other sensor capable of analyzing a ground characteristic.

Figure 2:
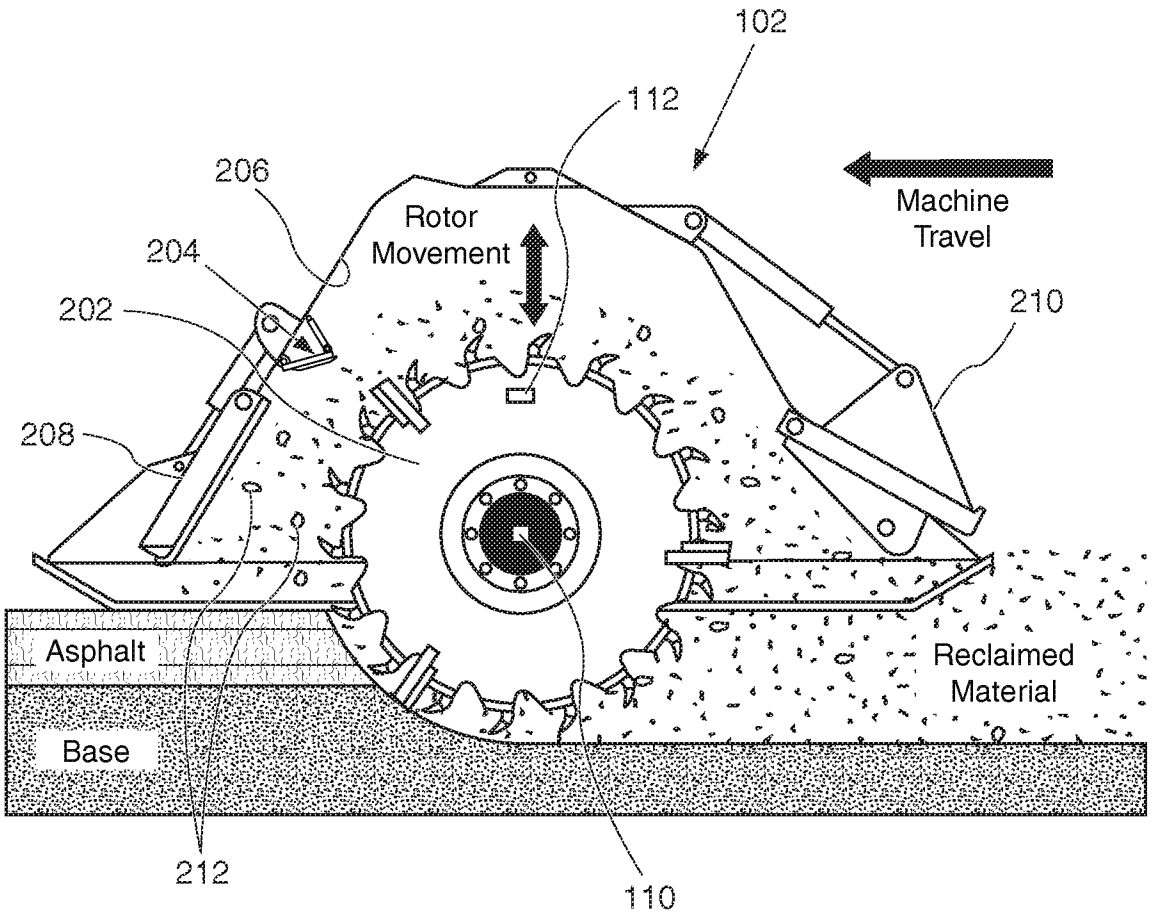
FIG. 2 is a diagrammatic view of the chamber of the exemplary machine shown in FIG. 1.

FIG. 2 illustrates a chamber 102 of machine 100. Chamber 102 includes a rotor 202, an adjustable sizing mechanism 204, an interior surface 206, a front door 208, and a rear door 210. As shown in FIG. 2, as machine 100 and chamber 102 move along the ground, rotor 202 breaks apart and pulverizes an asphalt and base layer into pieces 212, and pieces 212 are then used to form a layer of reclaimed material. One of skill in the art will appreciate that while FIG. 2 shows an asphalt layer and a base layer, the present disclosure is applicable to other layers found during road reclamation.

The position of front door 208, rear door 210, and the speed of rotor 202 affects the degree of pulverization by regulating the amount, direction, and speed of material flow through chamber 102. Adjustable sizing mechanism 204 is also used to control the degree of pulverization of pieces 212. Adjustable sizing mechanism 204, as will be described below, may be positioned at various distances from rotor 202 to set the degree of pulverization or, in other words, to set the maximum size or diameter of pieces 212 used in the layer of reclaimed material.

Coupled to rotor 202 is sensor 110 for measuring the height of rotor 202 and sensor 112 for measuring the speed of rotor 202. Sensor 110 and sensor 112 may be located at other locations and still be capable of measuring the height of rotor 202, in the case of sensor 110, and the speed of rotor 202, in the case of sensor 112.

Figure 3:
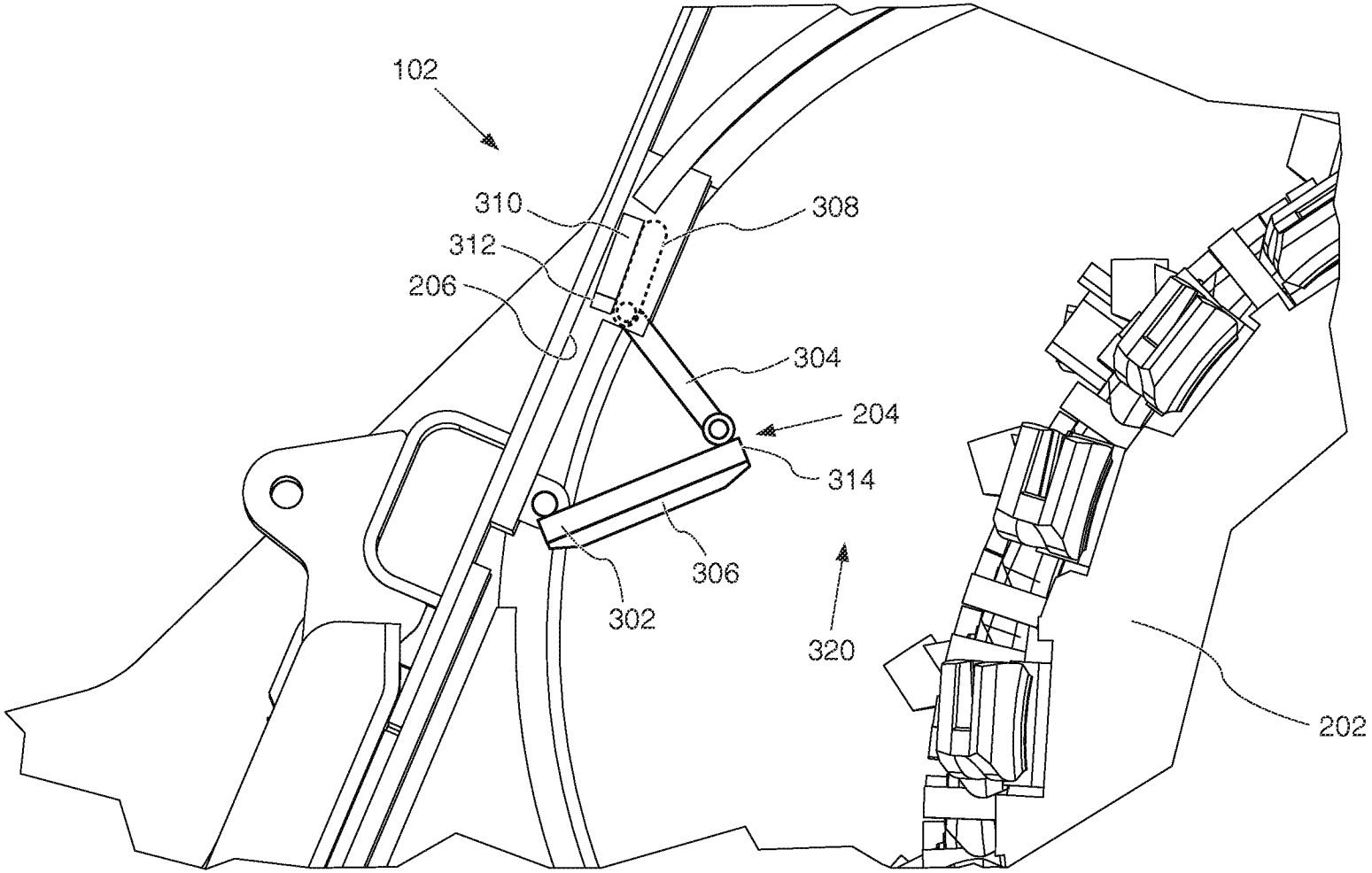
FIGS. 3 and 4 illustrate an exemplary adjustable sizing mechanism coupled to the interior surface of a chamber.

FIG. 3 shows adjustable sizing mechanism 204 in a first position. Adjustable sizing mechanism 204 contains a first member 302, a second member 304, a third member 306, and an edge 314. First member 302 is coupled to interior surface 206 by, for example, a hinge that allows first member 302 to pivot from a position fixed on interior surface 206. First member 302 and second member 304 are coupled to each other by, for example, a hinge. Second member 304 is coupled to interior surface 206 by, for example, a track 308. Track 308 can either be built into interior surface 206 or coupled to interior surface 206. An end of second member 304 moves along track 308, thereby slidably coupling that end of second member 304 to interior surface 206. In alternative embodiments, second member 304 could be coupled to interior surface 206 by other methods, so long as first member 302 was able to move relative to interior surface 206. Second member 304 helps to hold first member 302, and therefore the edge 314, in place.

Third member 306 may optionally be connected to first member 302. Third member 306 is constructed of a resilient and protective material and is placed between the first member 302 and the ground layer, to protect the first member 302 from sustaining damage from pieces 212. Third member 306 may be coupled to first member 302, for example by bolting or riveting, so that it can be easily removed and replaced if damaged or worn. Alternatively, first member 302 and third member 306 could be provided with grooves or slots that would allow third member 306 to slide onto first member 302 and lock in place. It is anticipated that third member 306 would need to be replaced from wear depending on the amount of time machine 100 is conducting pulverizing operations.

Adjustable sizing mechanism 204 may also contain an actuator 310 and a sensor 312 coupled to interior surface 206. Actuator 310 links the adjustable sizing mechanism 204 to the hydraulic system of machine 100 so that adjustable sizing mechanism 204 is moved by operation of the hydraulic system of machine 100. Alternatively, actuator 310 may optionally be located in either first member 302, second member 304, or on other locations of chamber 102 or interior surface 206. One of skill in the art will appreciate that adjustable sizing mechanism 204 may be moved by other means than hydraulic actuation. For example, adjustable sizing mechanism 204 may be moved by hand, by a chain gear, or by other methods known in the art.

Adjustable sizing mechanism 204 is coupled to interior surface 206 in such a way that a gap 320 is formed between adjustable sizing mechanism 204 and rotor 202. The length of gap 320 determines the maximum diameter of pieces 212. The length of gap 320 is defined by the distance between rotor 202 and adjustable sizing mechanism 204. For example, the length of gap 320 may be determined by measuring the distance from edge 314 of first member 302 to rotor 202. Sensor 312, coupled to actuator 310, uses actuator 310 to determine the position of the edge 314. That is, sensor 312 measures the actuation of actuator 310. The actuation of actuator 310 corresponds to a location of the edge 314. According to various alternative embodiments, actuator 310 may be a variety of different types of actuators, such as hydraulic cylinders or screw-type actuators.

Alternatively, sensor 312 could be located on track 308 itself, on edge 314, in the hinge rotatably coupling first member 302 to interior surface 206, or on numerous other portions of adjustable sizing mechanism 204, chamber 102, or interior surface 206 such that the output from sensor 312 could be used to calculate the position of edge 314. For example, if the actuator 310 was located in the second member 304, the sensor 312 could also be in second member 304.

Rotor 202 is often configured to move up or down in chamber 102, along a known path, and since rotor 202 has a fixed diameter, sensor 110 could be used to sense the height of rotor 202 to know the position of rotor 202. Then, a comparison can be made between sensor 312 and sensor 110 to measure the length of gap 320.

In FIG. 3, adjustable sizing mechanism 204 is shown in a first position where second member 304 is at one end of track 308. In this first position, the length of gap 320 is minimized, as edge 314 is in the position closest to rotor 202. When adjustable sizing mechanism 204 is in this first position, the maximum diameter of pieces 212 will be as small as chamber 102 can produce.

Figure 4:
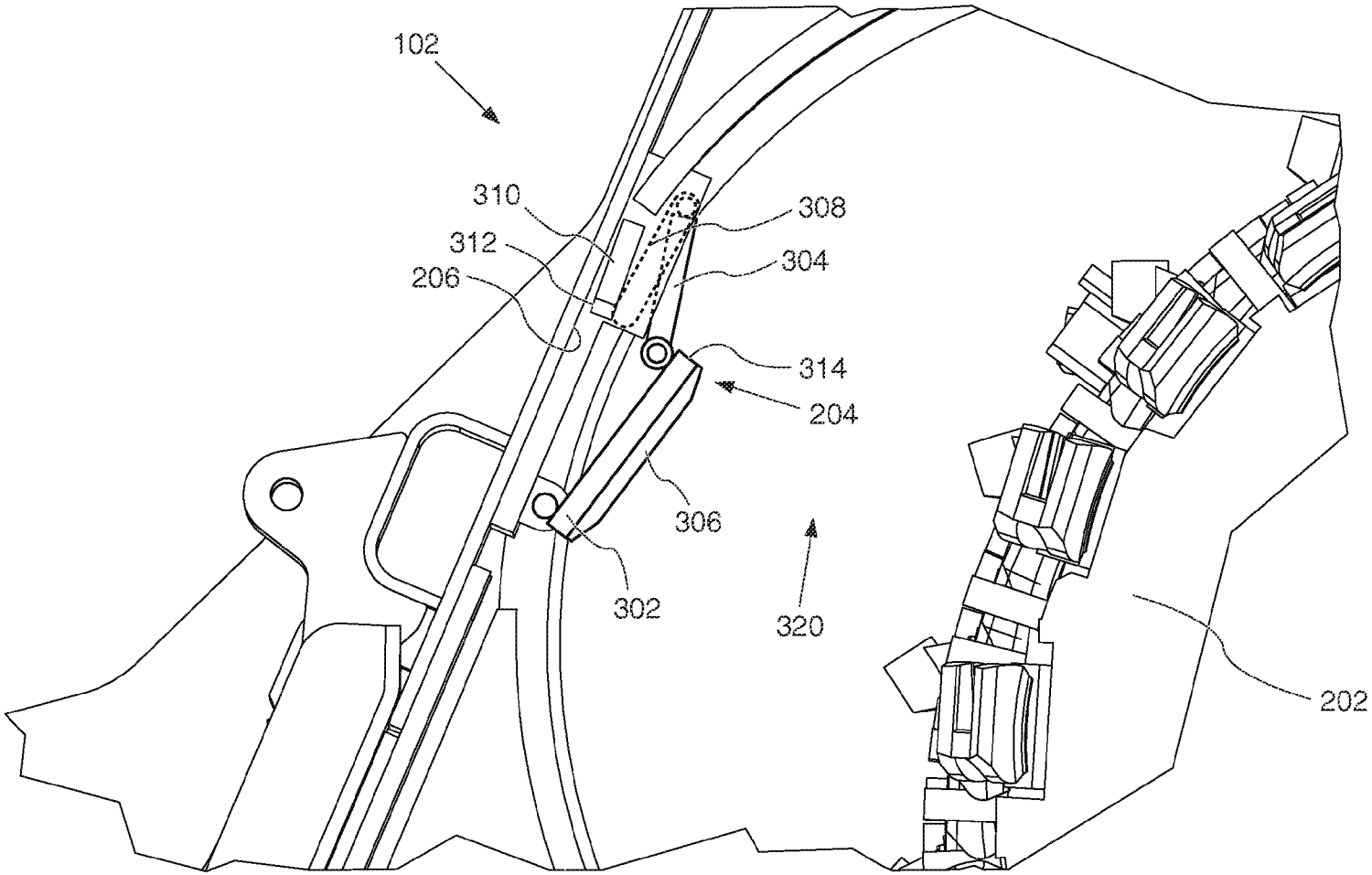

FIG. 4 shows adjustable sizing mechanism 204 in a second position with the same components described with respect to FIG. 3. In this second position, second member 304 of adjustable sizing mechanism 204 is at the other end of track 308 from that shown in FIG. 3. In this second position, the length of gap 320 is maximized, as edge 314 is in the position farthest from rotor. When adjustable sizing mechanism 204 is in this second position, the maximum diameter of pieces 212 will be as large as chamber 102 can produce.

Figure 5:
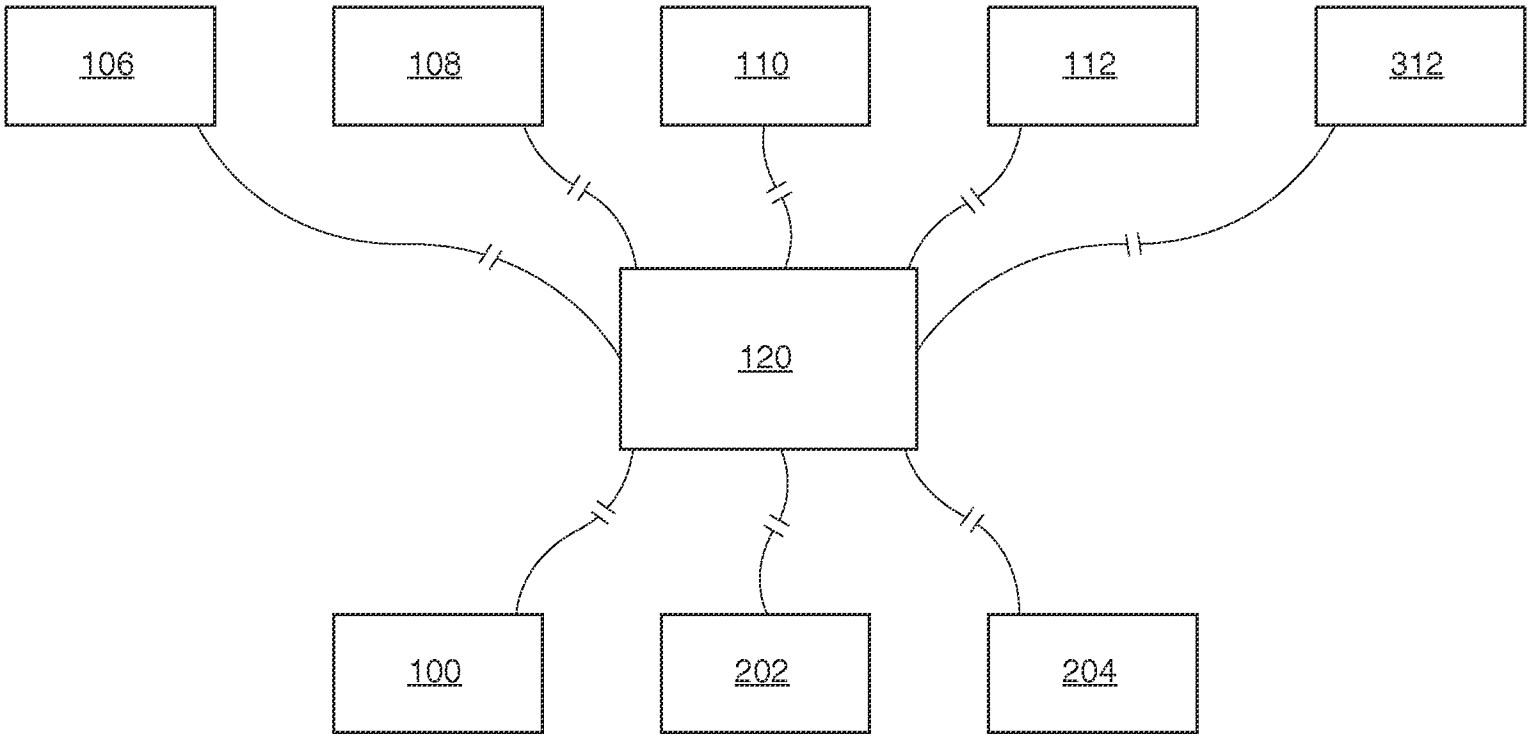
FIG. 5 is a diagrammatic view of an exemplary system for controlling a milling machine based on a ground characteristic.

FIG. 5 shows a diagrammatic view of an exemplary system for controlling machine 100 based on a ground characteristic. Sensor 106, sensor 108, sensor 110, sensor 112, and sensor 312 are communicably coupled with controller 120. This communication may be through either wired or wireless connection known in the art. Controller 120 takes the inputs from sensor 106, sensor 108, sensor 110, sensor 112, and sensor 312, and determines a target speed for machine 100, a target height for rotor 202, a target speed for rotor 202, and a target position for adjustable sizing mechanism 204. Controller 120 then adjusts the speed of machine 100 to the target speed of machine 100, the height of rotor 202 to the target height for rotor 202, the speed of rotor 202 to the target speed of rotor 202, and the position of adjustable sizing mechanism 204 to the target position for adjustable sizing mechanism 204.

While FIG. 5 shows an exemplary system, one of skill in the art will appreciate that the system may contain one or more of sensor 106, sensor 108, sensor 110, sensor 112, and sensor 312. Likewise, controller 120 may determine one or more of a target speed for machine 100, a target height for rotor 202, a target speed for rotor 202, and a target position for adjustable sizing mechanism 204. Finally, controller may adjust one or more of the speed of machine 100 to the target speed of machine 100, the height of rotor 202 to the target height for rotor 202, the speed of rotor 202 to the target speed of rotor 202, and the position of adjustable sizing mechanism 204 to the target position for adjustable sizing mechanism 204.

INDUSTRIAL APPLICABILITY

The present disclosure allows for control of machine 100 in response to objects detected under the ground surface to avoid damage to rotor 202. In an exemplary embodiment, sensor 106 detects objects under the surface of the ground. Sensor 108 detects the speed of machine 100. Sensor 110 detects the height of rotor 202. When sensor 106 senses an object, controller 120 analyzes whether rotor 202 will come into contact with the object and be potentially damaged. If controller 120 determines that rotor 202 would be damaged, controller 120 will determine a target height for rotor 202 and a target speed for machine 100 and adjust the speed of machine 100 to the target speed for machine 100 and adjust the height of rotor 202 to the target height for rotor 202 to avoid the underground object. When machine 100 is clear of the underground danger, controller 120 can adjust the speed of machine 100 and the height of rotor 202 to their pre-object detection states.

In an alternative embodiment, machine 100 may also be equipped with sensor 112. Sensor 112 detects the speed of rotor 202. Upon detection of an underground object by sensor 106, controller 120 may, in addition to altering the speed of machine 100 and the height of rotor 202, determine a target speed for rotor 202 and alter the speed of rotor 202 to the target speed for rotor 202. For example, it may be desirable to stop rotor 202 completely in certain circumstances, or at least to slow it down considerably.

The present disclosure also allows for control of machine 100 in response to ground density and/or material thickness. In an exemplary embodiment, sensor 106 detects the density and/or material thickness of the ground in front of rotor 202. Sensor 108 detects the speed of machine 100. Sensor 110 detects the height of rotor 202. When sensor 106 senses the density and/or material thickness of the ground in front of rotor 202, controller 120 analyzes the density and/or material thickness and determines a target height for rotor 202 and a target speed for machine 100. Then controller 120 will adjust the speed of machine 100 to the target speed for machine 100 and adjust the height of rotor 202 to the target height for rotor 202 to control the ground density and/or material thickness.

Sensor 106, when it detects the thickness of the material, may raise or lower rotor 202 to maintain a specific mixing ratio or to maintain that rotor 202 is completely cutting through the material if the material suddenly thickens. Sensor 106, when it detects the density of the material, may also change the speed of machine 100 and/or the speed of rotor 202 to most efficiently cut the material to the required gradation. For example, if the material becomes less dense, machine 100 and/or rotor 202 may speed up to get through the material quicker. If the material becomes more dense, machine 100 and/or rotor 202 may slow down to cut and pulverize the material to the required gradation.

In an alternative embodiment, machine 100 may also be equipped with sensor 112. Sensor 112 detects the speed of the rotor. Upon detection of ground density and/or material thickness by sensor 106, controller 120 may, in addition to altering the speed of machine 100 and the height of rotor 202, determine a target speed for rotor 202 and alter the speed of rotor 202 to the target speed for rotor 202. For example, it may be desirable to stop rotor 202 completely in certain circumstances, or at least to slow it down considerably. In another alternative embodiment, machine 100 may also be equipped with adjustable sizing mechanism 204 which includes sensor 312. Sensor 312 provides controller 120 with information on the position of adjustable sizing mechanism 204. Controller 120 determines a target position for adjustable sizing mechanism 204 and adjusts the position of adjustable sizing mechanism 204 to the target position for adjustable sizing mechanism 204. In these alternative embodiments, allowing controller 120 to adjust the speed of rotor 202 and the position of adjustable sizing mechanism 204 allows better control of material gradiation being processed by machine 100.

In alternative embodiments, the actuators of front door 208 and rear door 210 are equipped with position sensors. These sensors are connected to controller 120, and in conjunction with sensors 106, 108, 110, 112, and 312 can be used to control material gradation and pulzerization. Controller 120 can control the position of front door 208 and rear door 210 to accomplish that function.

Although certain embodiments have been illustrated and described herein for purposes of description, it will be appreciated by those of ordinary skill in the art that a wide variety of alternate and/or equivalent embodiments or implementations calculated to achieve the same purposes may be substituted for the embodiments shown and described without departing from the scope of the present disclosure. Those with skill in the art will readily appreciate that embodiments in accordance with the present invention may be implemented in a very wide variety of ways. This application is intended to cover any adaptations or variations of the embodiments discussed herein. Therefore, it is intended that embodiments in accordance with the present invention be limited only by the claims and the equivalents thereof.

What is claimed is:

1. A milling machine comprising:
- a frame;
- a rotor coupled to the frame and vertically adjustable;
- a chamber coupled to the frame and at least partially surrounding the rotor;
- a speed sensor configured to measure a speed of the machine;
- a height sensor configured to measure a height of the rotor;
- a ground characteristic sensor configured to measure a ground characteristic;
- a controller configured to:
  - receive the speed of the machine from the speed sensor;
  - receive the height of the rotor from the height sensor;
  - receive the ground characteristic from the ground characteristic sensor;
  - determine a target speed for the machine based on the ground characteristic;
  - determine a target height for the rotor based on the ground characteristic;
  - adjust the speed of the machine to the target speed; and
  - adjust the height of the rotor to the target height.

2. The milling machine of claim 1, wherein the chamber includes an adjustable sizing mechanism having a position and capable of being moved from a first position to a second position and to any intermediate position in between the first position and the second position.

3. The milling machine of claim 2, further comprising a sensor for measuring the position of the adjustable sizing mechanism.

4. The milling machine of claim 3, wherein the controller is further configured to:
- receive the position of the adjustable sizing mechanism;
- determine a target position for the adjustable sizing mechanism; and
- adjust the position of the adjustable sizing mechanism to the target position.

5. The milling machine of claim 1, wherein the ground characteristic sensor is a ground penetrating radar.

6. The milling machine of claim 5, wherein the ground characteristic is a density of the ground.

7. The milling machine of claim 1, further comprising a second speed sensor configured to measure the speed of the rotor.

8. The milling machine of claim 7, wherein the controller is further configured to:

receive the speed of the rotor;

determine a target speed for the rotor based on the ground characteristic; and adjust the speed of the rotor to the target speed.

9. The milling machine of claim 8, wherein the controller is further configured to:

determine a target speed for the machine based on the height of the rotor.

10. The milling machine of claim 9, wherein the controller is further configured to:

determine a target height for the rotor based on the speed of the machine.

* * * * *